US010989422B1

(12) United States Patent
Chase, Jr.

(10) Patent No.: US 10,989,422 B1
(45) Date of Patent: Apr. 27, 2021

(54) EFFICIENT AIR PROCESSING SYSTEM WITH HEAT PIPE

(71) Applicant: William R. Chase, Jr., Enfield, NH (US)

(72) Inventor: William R. Chase, Jr., Enfield, NH (US)

( * ) Notice: Subject to any disclaimer, the term of this patent is extended or adjusted under 35 U.S.C. 154(b) by 0 days.

(21) Appl. No.: 16/457,685

(22) Filed: Jun. 28, 2019

(51) Int. Cl.
*F24F 3/14* (2006.01)
*F24F 7/06* (2006.01)

(52) U.S. Cl.
CPC ..... *F24F 3/14* (2013.01); *F24F 7/06* (2013.01); *F24F 2003/144* (2013.01)

(58) Field of Classification Search
CPC .... F24F 3/14; F24F 3/147; F24F 3/153; F24F 7/06; F24F 7/08; F24F 2003/144
See application file for complete search history.

(56) References Cited

U.S. PATENT DOCUMENTS 4,607,498 A 8/1986 Dinh
4,667,479 A 5/1987 Doctor
4,761,966 A 8/1988 Stark
4,827,733 A 5/1989 Dinh
4,841,733 A 6/1989 Dussault et al.
4,938,035 A 7/1990 Dinh
5,179,998 A 1/1993 Des Champs
5,333,470 A 8/1994 Dinh
5,448,897 A 9/1995 Dinh
5,749,415 A 5/1998 Dinh
5,845,702 A 12/1998 Dinh
5,921,315 A 7/1999 Dinh
6,205,805 B1 * 3/2001 Takahashi ..... F24F 3/1423 62/271
8,943,848 B2 * 2/2015 Phannavong ..... F24F 3/0442 62/160
9,435,551 B2 9/2016 Dinh
2002/0040575 A1 * 4/2002 Okano ..... F24F 3/147 60/39.511
2002/0164944 A1 * 11/2002 Haglid ..... F24F 12/006 454/228
2014/0260367 A1 * 9/2014 Coutu ..... F24F 3/147 62/89
2016/0069575 A1 3/2016 Anderson

FOREIGN PATENT DOCUMENTS

EP 2708829 A2 3/2014

OTHER PUBLICATIONS

Industrial Air—QDT, "HVAC Air to Air Thermal Recovery Units", 2016, Torrensville, SA, AU.
Kosar, D. et al., "Integrating Advanced Humidity Control to Reduce Energy Use", Jun. 2017, National Center for Energy Management and Building Technologies, Alexandria, VA, US.

* cited by examiner

*Primary Examiner* — Tavia Sullens
(74) *Attorney, Agent, or Firm* — Jeffrey E. Semprebon

(57) ABSTRACT

Dehumidification efficiency in an air processing system can be increased by mixing cooled exhaust air with incoming fresh air prior to cooling the incoming air to reduce its moisture content. Cooling the incoming air brings it closer to its dewpoint, allowing a cooling element to use more of its capacity for reducing latent heat than sensible heat.

6 Claims, 6 Drawing Sheets

EFFICIENT AIR PROCESSING SYSTEM WITH HEAT PIPE

TECHNICAL FIELD

The present disclosure related to air processing systems suitable for high humidity interior spaces, and which is particularly well-suited for natatoriums.

BACKGROUND

Indoor spaces containing pools have a number of competing air processing requirements to maintain an environment conducive to health and comfort, as well as to reduce damage due to excess moisture. For example, in the United States, building codes require (based on the pool surface area, occupancy, etc.) a minimum introduction of fresh air, a minimum volume of circulation, and a negative pressure in the enclosed space (thus, combined with the required fresh air intake, effectively creating a minimum exhaust flow). Additionally, the space should be maintained at a desired temperature and humidity (for example, 85° F. and 60% relative humidity) for the comfort of the users. Balancing these requirements as temperature and humidity of the outside air brought in as fresh air changes, requires adjustment of the air flow, and frequently requires dehumidification and temperature regulation of the incoming air, recirculated air, or both. In more humid conditions, dehumidification, in particular, is often extremely consumptive of energy.

One early attempt to reduce the cost of dehumidification is taught in U.S. Pat. No. 4,841,733, where a "heat pipe" type heat exchanger is employed to help dehumidify recirculated air. Such heat pipes transfer heat by cooling air that passes through an evaporator side (where heat from the air is extracted to vaporize a liquid in the heat pipe) and warming air passing through a condenser side, where heat from the vapor inside the heat pipe is given off as the vapor condenses back into a liquid, before flowing or being pumped back to the evaporator side. When the system of the '733 patent operates in a "summer dehumidification mode", exhaust air removed from the natatorium is passed through the evaporator side of the heat pipe, reducing its temperature and thus increasing its relative humidity (since cooler air can contain less water vapor before becoming saturated). The cooled air is then passed through a cooling element, to remove moisture, before being returned to the natatorium through the condenser side, reheating the air after a substantial portion of moisture has been removed. The reduction of the relative humidity obtained by passing the air through the evaporator section makes the cooling element operate more efficiently, since the air is closer to its dewpoint when it reaches the cooling element, and thus less energy is needed to reduce sensible heat before removing latent heat to remove moisture from the air.

In an effort to reduce energy costs while meeting the requirements to provide a sufficient flow of incoming fresh air, Applicant has introduced the use of a vertical heat pipe in the air processing system, with a cooling portion (evaporator section) located in the exhaust air path so as to extract heat from the exhaust air, and a heating portion (condenser section) located in the intake air path so as to selectively pre-heat incoming fresh air (when such pre-heating is not needed, the incoming air can be diverted around the condenser section of the heat pipe). When necessary, the fresh air is typically first passed through a cooling element to reduce its humidity, making subsequent heating more efficient. Heat pipes such as used in this system are commercially available, such as passive heatpipe Model HRM-O™ sold by Heat Pipe Technology.

FIG. 1 shows one example of such an air processing system 100 designed and manufactured by the applicant. Other manufacturers have replicated all or some of the features of this system. The system 100 is housed in an enclosure 102, and is generally divided into an intake air path 104, an exhaust air path 106, and a return air path 108; in the system 100, the return air path 108 may supply air to both the intake air path 104 and the exhaust air path 106. A vertical heat pipe 110 extends between the air paths 104 & 106, having an evaporator section 112 positioned in the exhaust air path 106, and a condenser section 114 positioned in the intake air path 104. Thus, under typical conditions, heat is extracted by the evaporator section 112 from the exhaust air flow, indicated by arrow 116, cooling it, and is transferred to the condenser section 114, where it can be used to heat incoming fresh air, indicated by arrow 118. Even when the outside temperature is high, the incoming fresh air 118 frequently needs to be cooled to reduce its humidity, to maintain the humidity in the natatorium at a comfortable level, and low enough to avoid excess condensation. Such cooling may be done by intake cooling element 120, and the cooled air can then be reheated by heat transferred from condenser section 114 before being introduced into the natatorium. When such heating is not desired, the air (or portion thereof) can be diverted around the condenser section 114 by opening a condenser bypass damper 122 and closing a condenser face damper 124. Similarly, the flow of air through the intake cooling element 120 can be controlled by cooling element face damper 126 and a cooling element bypass damper 128. Additional heating and cooling can be provided by return air cooling element 130 and return air heating elements 132 & 134, which act on both the incoming fresh air 118 and a return air flow, indicated by arrow 136, which enters the intake path 104 from the return air path 108 through a recirculation damper 138. The fresh air 118 and return air 136 are both blown into the natatorium (not shown, off the left side of FIG. 1) by a supply fan 140, and balance of fresh air 118 to return air 136 can be controlled by adjusting the recirculation damper 138 and an intake damper 142. An intake filter 144 is typically also provided to remove dust, pollen, and other undesirable particulate matter.

In the system 100 illustrated, the exhaust air 116 is blown by exhaust fan 146, which is positioned in the exhaust air path 106 beyond the recirculation damper 138. Depending on how much heating of incoming air is expected, the amount of exhaust air 116 passing through the evaporator section 112 can be controlled by opening an exhaust bypass damper 148, which allows the air 116 to bypass the evaporator section 112. A return air filter 150 is typically provided to filter the air being returned from the natatorium.

Such systems have provided a considerable energy savings in cooler climates, where the incoming fresh air is frequently low in humidity and/or at a temperature where it does require heating. They offer less benefit in warmer climates where the incoming air is already at a sufficiently high temperature and humidity level for a significant portion of the operating time.

SUMMARY

Applicant has found that reduced energy consumption can be attained by not only employing a heat pipe extending from the exhaust air path to the intake air path (heating mode), as described above, but also by providing a "wrap-around" air path that can selectively divert return air from the exhaust air path, at a position downstream of the cooling (evaporator) section of the heat pipe, and mixing this air with incoming fresh air prior to passing the mixed air through a cooling element. Mixing this cooled air with the incoming fresh air reduces the temperature of the fresh air before it reaches the cooling element, allowing the cooling element to use more of its capacity for reducing latent heat to remove moisture, since much of the work of reducing sensible heat has already been done. The dehumidified air then passes through the heating (condenser) section of the heat pipe to raise its temperature before it is introduced to the natatorium.

One approach is to provide a wrap-around damper that introduces cooled exhaust air into the intake air path upstream of the intake cooling element, allowing it to mix with incoming fresh air to cool it before it passes through the cooling element. When operating in conditions where the humidity of the air supplied to the natatorium must be reduced and the incoming fresh air is too humid to provide the desired reduction, a portion of the air to be returned is not diverted directly into the incoming air path, but instead is first cooled by passing it through the cooling (evaporator) section of the heat pipe and then diverting it into the intake air path to mix with and cool the incoming fresh air before it is cooled by the intake cooling element. This cooling effect from the air that would otherwise be recirculated or exhausted significantly reduces the energy requirements of the cooling element, as more of its capacity is available for dehumidification, since the incoming air has already been cooled to a temperature close to its dewpoint, reducing the work required by the cooling element before it can begin removing moisture. The additional cooling effect to reduce the work of the cooling element is essentially free, with the only increased energy consumption being a slight increase in fan energy, necessary to overcome the resistance load of air passing through the heat pipe.

Still further advantage can be obtained by providing a dehumidification air path that selectively directs fresh air into the exhaust airflow path at a location upstream of the exhaust blower, such that the incoming fresh air can mix with the exhaust air before passing through the cooling (evaporator) section of the heat pipe and before being directed through the wrap-around air path and passing through the cooling element. Passing the high-humidity fresh air through the cooling (evaporator) section of the heat pipe directly reduces its temperature, reducing the amount of cooling that must be done by the cooling element, as well as significantly increasing the efficiency of the cooling element (since the temperature of the air has been reduced, less energy of the cooling element is required for sensible cooling and more is available for reducing the latent heat content of the air (dehumidification)).

DETAILED DESCRIPTION

Figure 2:
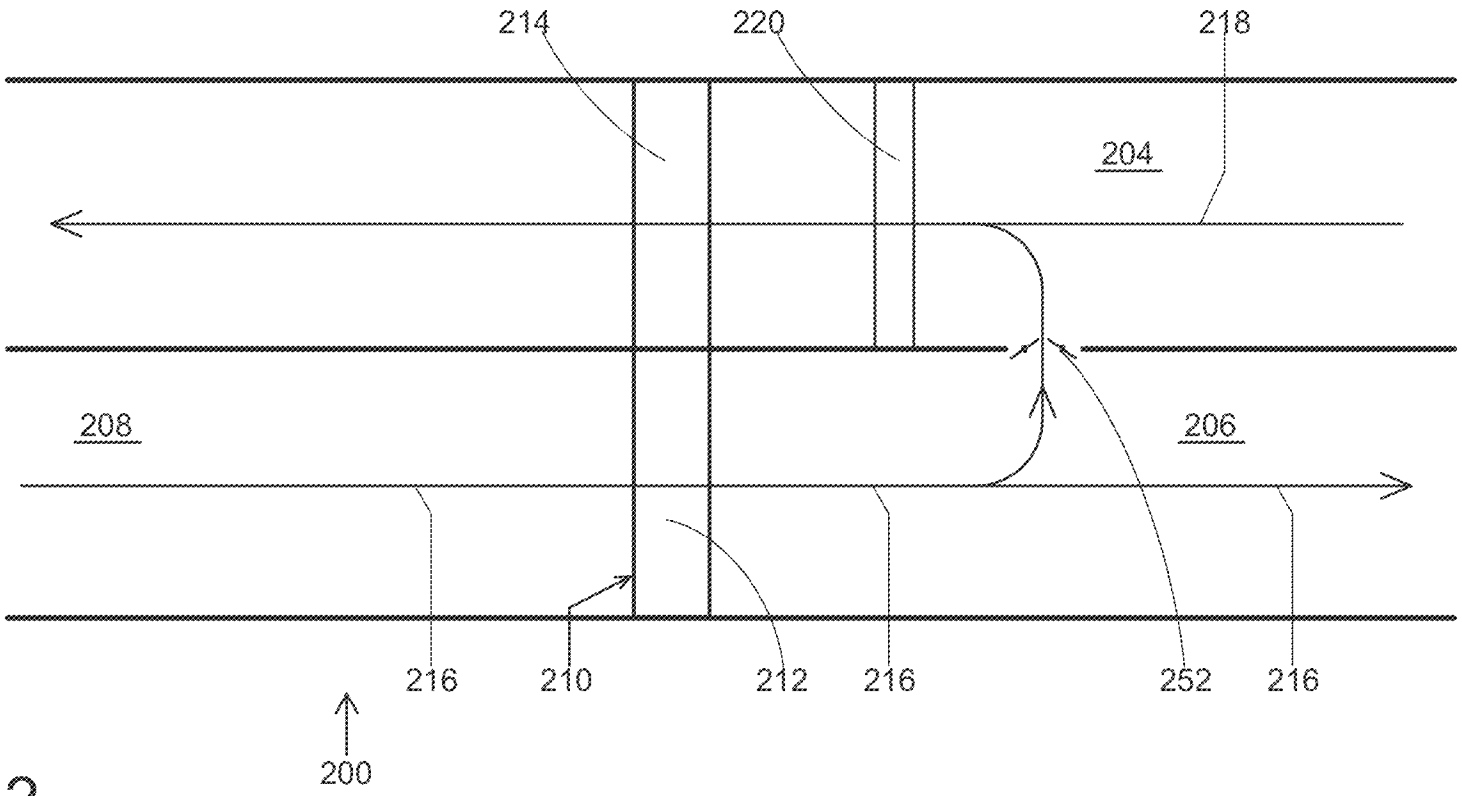
FIG. 2 is a schematic diagram showing the basic elements of an air processing system that provides a recirculation air flow path to mix return air, that has passed thru the evaporator section of the vertical heat pipe, into the incoming fresh air prior to its passage through an intake cooling element.

FIG. 2 is a schematic illustration of an air processing system 200 which offers reduced energy consumption. The system 200 incorporates many elements similar to the prior art system 100, having an intake air path 204, an exhaust air path 206, and a return air path 208, and having a vertical heat pipe 210 that extends between the air paths 204 & 206. Again, an evaporator section 212 of the heat pipe 210 is positioned in the exhaust air path 206, and a condenser section 214 is positioned in the intake air path 204. Incoming fresh air 218 is typically cooled by an intake cooling element 220 to reduce its humidity prior to its introduction to the condenser section 214, where it is reheated.

To reduce the energy consumption required to cool the incoming fresh air 218 and allow the intake cooling element 220 to operate more effectively, the system 200 is provided with a wrap-around damper 252 that can be opened to allow exhaust air 216, which has been cooled by passing through the evaporator section 212, to mix with the incoming fresh air 218 to reduce its temperature prior to passing through the cooling element 220. In a typical operating situation, the incoming fresh air 218 has a higher humidity than desired and must be cooled to condense moisture from the fresh air 218 to dehumidify it. Opening the wrap-around damper 252 to mix the cooled exhaust air 216 with the fresh air 218 reduces its temperature, resulting in energy savings and a reduction in the required capacity of the cooling element 220. To remove moisture, the humid air must first be cooled to its dewpoint, after which further cooling acts to remove moisture.

Figure 1:
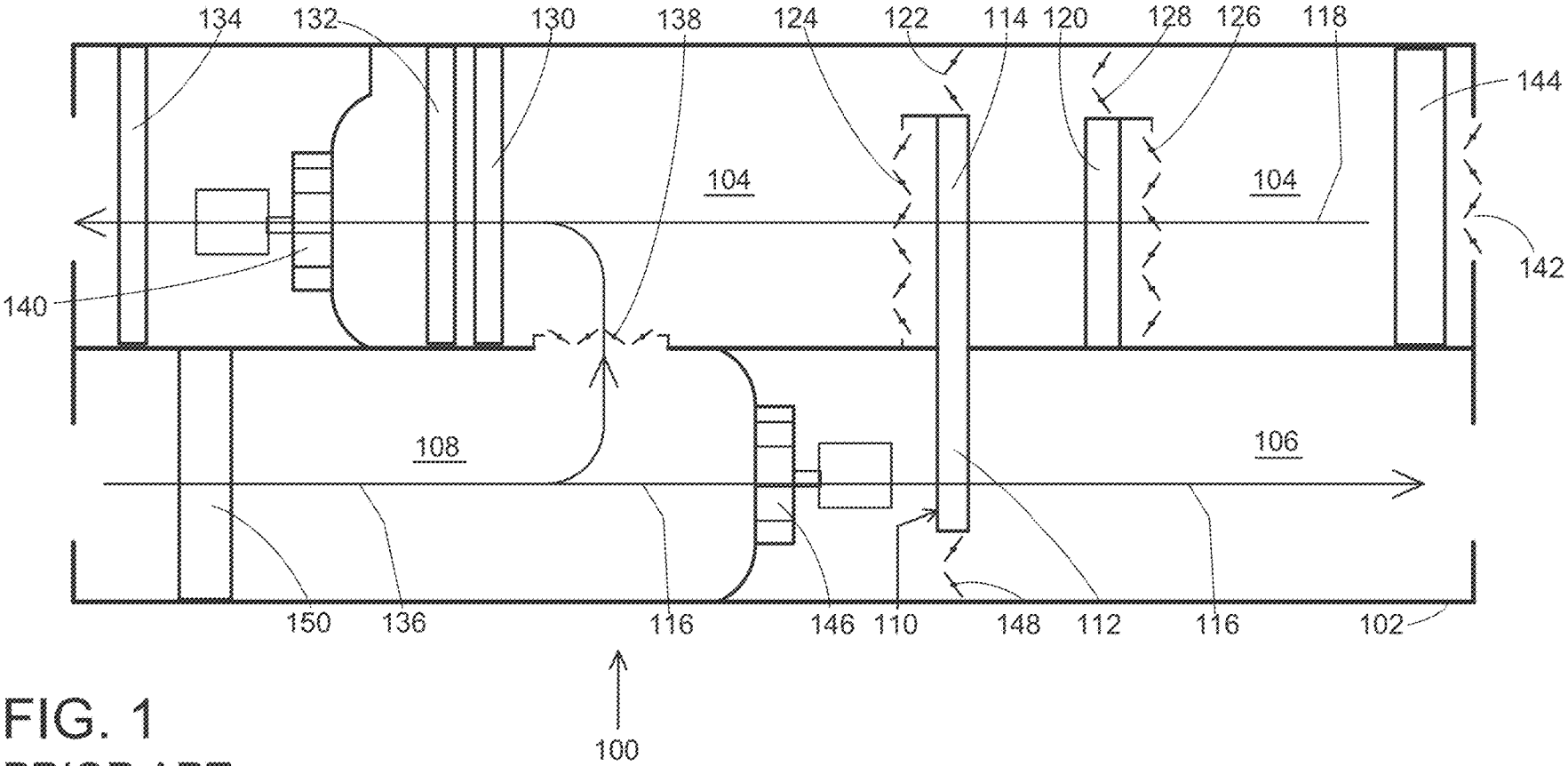
FIG. 1 PRIOR ART
FIG. 1 illustrates a prior art air processing system for supplying air to a natatorium, and which employs a vertical heat pipe to reduce the energy consumed heating incoming fresh air.

In a conventional air processing system such as the system 100 shown in FIG. 1, a considerable portion of the cooling capacity of the intake cooling element 120 is required just to cool the incoming air to its dewpoint, before it can start to remove moisture from the air. In contrast, in the system 200, mixing the incoming fresh air 218 with the cooled exhaust air lowers its temperature prior to passing into the cooling element 220, so that less of the capacity of the cooling element 220 is required to bring the air to its dewpoint, and more of the capacity is available for removing moisture. Under some conditions, the temperature and humidity are such that the evaporator section 212 cools the exhaust air 216 passing therethrough enough to start dehumidifying it, resulting in not only cooler, but less humid air when it mixes with the incoming fresh air 218. After moisture is removed by the cooling element 220, the dry air can then be reheated by passing through the condenser section 214 of the heat pipe 210. While the system 200 illustrated uses the cooling element 220 positioned in the intake air path 204, it should be appreciated that alternative configurations could be employed to mix the cooled exhaust air with the incoming fresh air to reduce the work that must be done by a cooling element.

Figure 3:
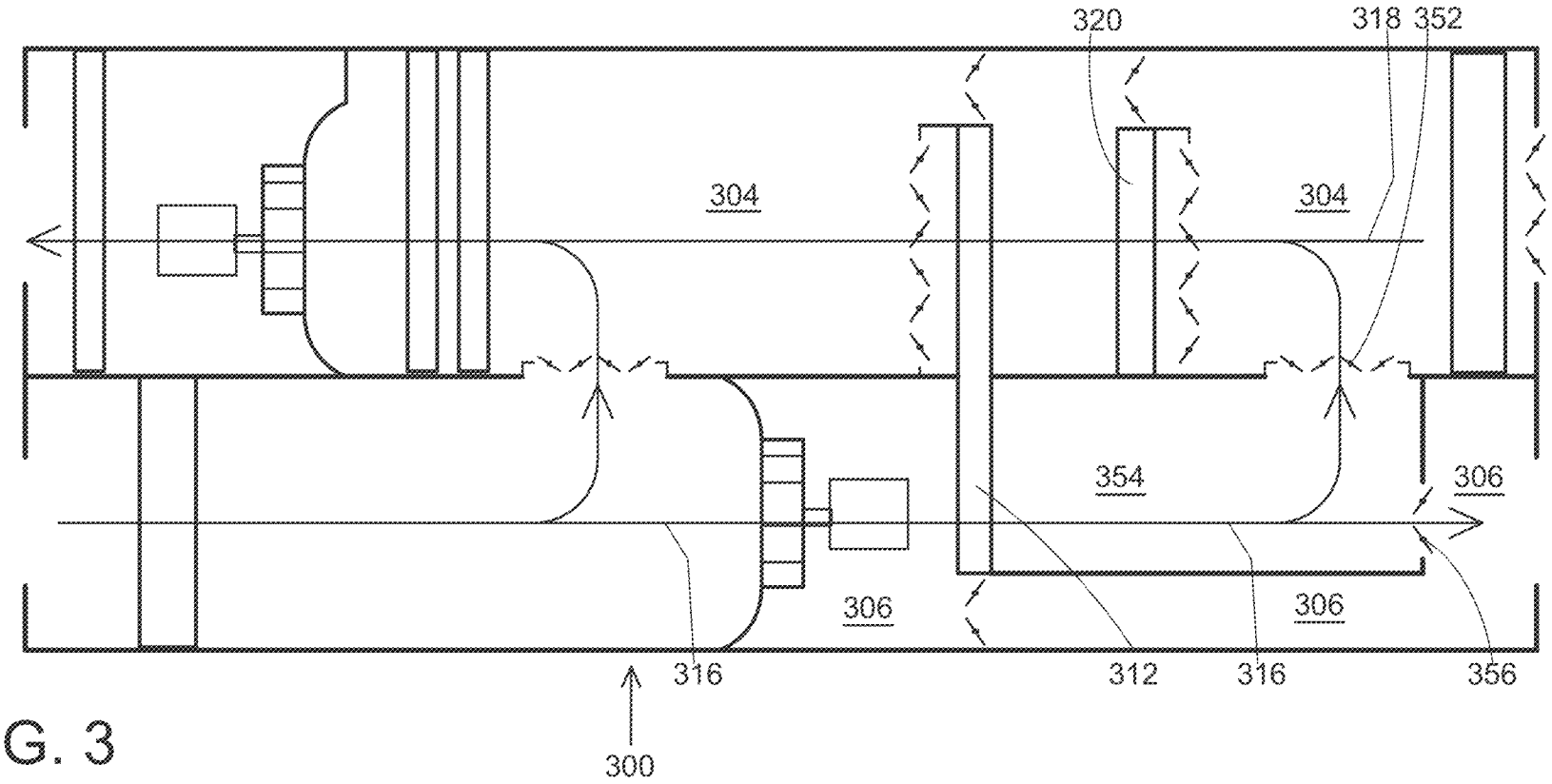
FIG. 3 illustrates one example of an air processing system incorporating the elements shown in FIG. 2.

FIG. 3 shows one example of an air processing system 300 that incorporates basic elements similar to those of the system 200. The system 300 illustrated includes all the components found in the prior art system 100, but has a partition that separates out a portion of the exhaust air path 306 to form a wrap-around air path 354. The wrap-around air path 354 receives exhaust air 316 that has been cooled by passage through the evaporator section 312. Air flowing through the wrap-around air path 354 can be introduced into an intake air path 304 through a wrap-around damper 352, to mix with and cool the incoming fresh air 318. In the system 300 illustrated, this cooled exhaust air is introduced upstream of an intake cooling element 320, and acts to cool the incoming fresh air 318 to reduce the work that must be done by the intake cooling element 320. When this additional cooling action is not required, exhaust air 316 is allowed to exit from the system 300 through post-evaporator exhaust damper 356. Otherwise, operation of the system 300 is similar to that of the system 100.

Figure 4:
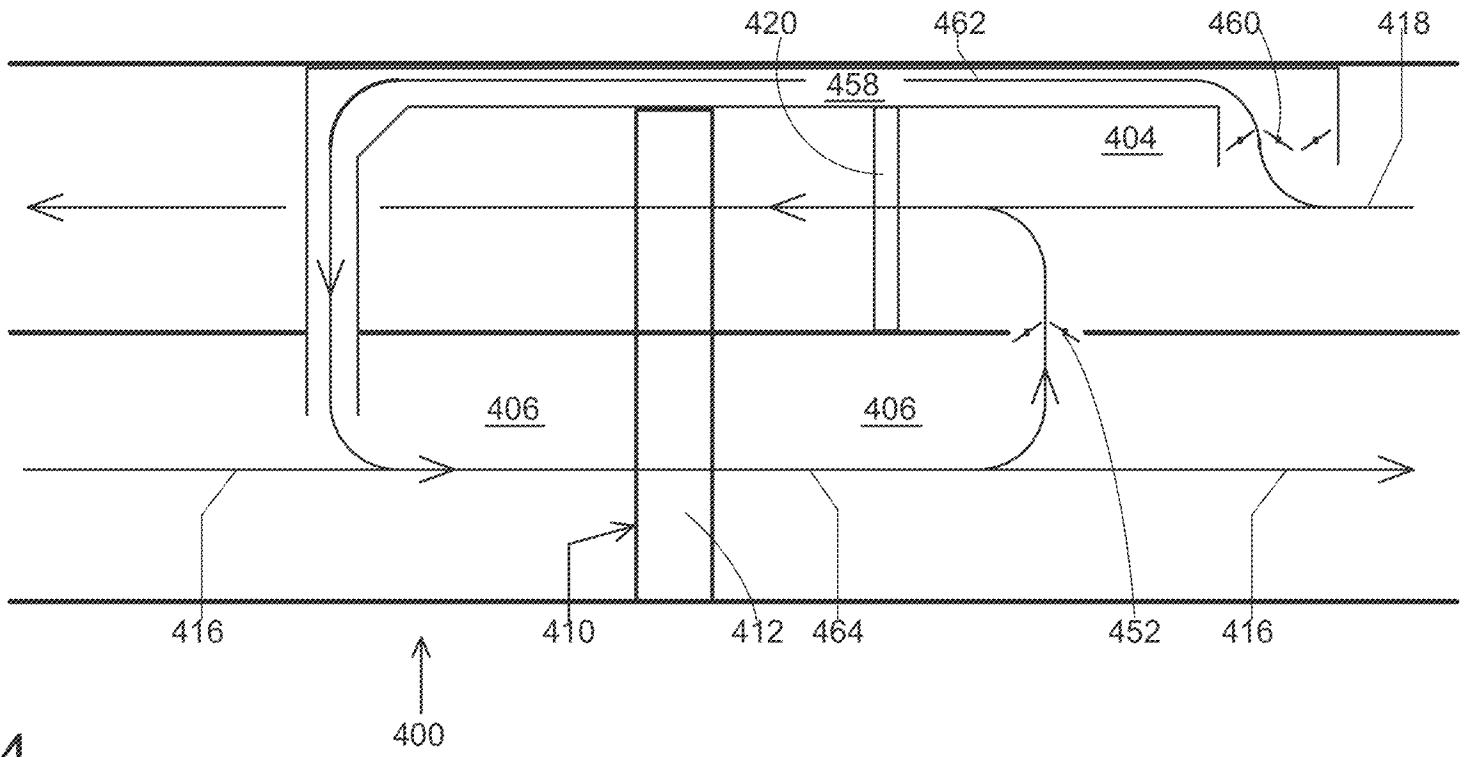
FIG. 4 is a schematic diagram showing the basic elements of an air processing system that is similar to that shown in FIG. 2, but which additionally has a fresh air dehumidification air path that can introduce incoming fresh air into the evaporator section of the vertical heat pipe such that it is pre-cooled prior to being cooled to reduce its moisture content, such as by passing through an intake cooling element.

FIG. 4 is a schematic illustration of an air processing system 400 which offers further reduced energy consumption by using a vertical heat pipe 410 to provide direct cooling of incoming fresh air 418 before it passes through an intake cooling element 420. The system 400 has many elements in common with the system 200 shown in FIG. 2, but additionally has a dehumidification air path 458, provided by a duct or similar air path structure. The dehumidification air path 458 can divert incoming fresh air 418 from an intake air path 404 through a dehumidification damper 460 and introduce this diverted fresh air 462 into an exhaust air path 406 at a location upstream of an evaporator section 412 of the heat pipe 410, from which it can be passed back into the intake air path 404 through a wrap-around damper 452, being introduced at a lower temperature (and possibly lower humidity) due to its passage through the evaporator section 412. Thus, the diverted air 462 has already had its temperature reduced before passing into an intake cooling element 420, making more of the capacity of the intake cooling element 420 available for removing moisture, since much (or all, in some cases) of the work to reduce the air temperature to its dewpoint has already been done by the evaporator section 412. It should be noted that the wrap-around damper 452 also allows exhaust air 416 that has passed through the evaporator section 412 to pass into the intake air path 404. In this mode of operation, a mixed airstream 464 contains both diverted fresh air 462 and exhaust air 416 that have both been cooled by passage through the evaporator section 412. As with the system 200 shown in FIG. 2, alternative configurations could be employed; for example, FIGS. 5 & 6 illustrate two possible alternatives.

Figure 5:
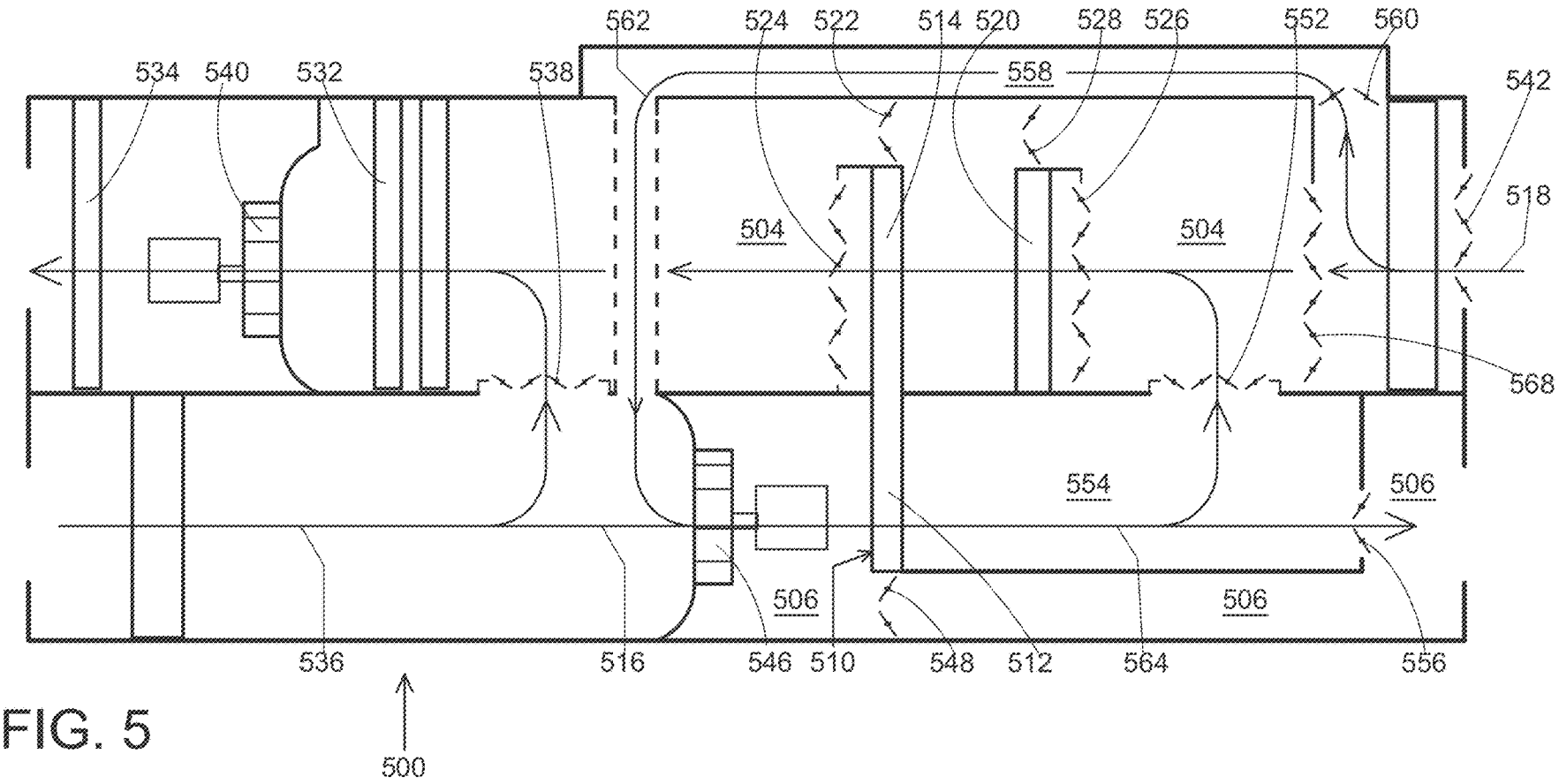
FIG. 5 illustrates one example of an air processing system incorporating the elements shown in FIG. 4. The system shares many features in common with the system shown in FIG. 3.
Figure 6:
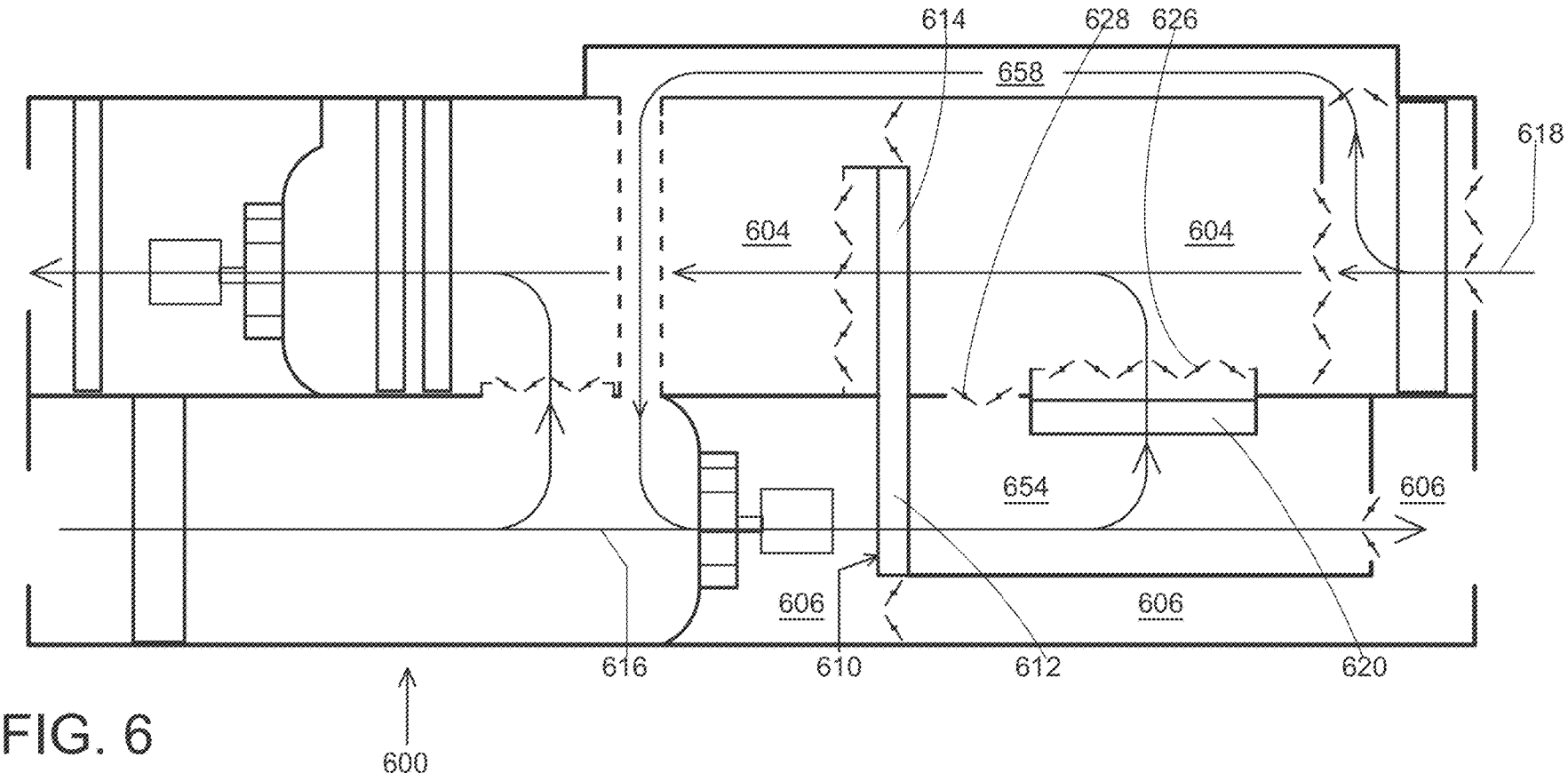
FIG. 6 illustrates another example of an air processing system with a dehumidification air path, incorporating many of the elements shown in FIG. 5, but differing in the structure for diverting air back into the intake air path and cooling it.

FIG. 5 shows one example of an air processing system 500 that incorporates the elements shown in FIG. 4 for the system 400. The system 500 employs many of the same elements of the system 300 described above, and the operation of these elements is similar except as discussed below. The system 500 has an intake air path 504 where incoming fresh air 518 can be directed through dehumidification path damper 560 or through a dehumidification bypass damper 568, or partially through both. Air directed through the dehumidification bypass damper 568 may subsequently pass through a cooling element face damper 526 or through the cooling element bypass damper 528, or partially through both, depending on the cooling and/or dehumidification needs.

Additionally, incoming fresh air 518 can be allowed to pass into a dehumidification air path 558 via the dehumidification path damper 560. The dehumidification air path 558 directs this diverted fresh air 562 into an exhaust air path 506, at a location just upstream of an exhaust fan 546, and downstream of a recirculation damper 538. The diverted fresh air 562 delivered through the dehumidification air path 558 mixes with exhaust air 516 and passes through an evaporator section 512 of a vertical heat pipe 510, cooling and possibly dehumidifying it. This mixed airstream 564, consisting of diverted fresh air 562 and exhaust air 516 that have been cooled by the evaporator section 512, then passes through a wrap-around damper 552 and returns to intake air path 504, downstream of dehumidification bypass damper 568. A portion of the exhaust air 516 may be directed through exhaust bypass damper 548 as necessary to maintain desired natatorium pressure.

Typically, when the dehumidification path damper 560 is open, a post evaporator exhaust damper 556 is closed, and dehumidification bypass damper 568 may also be closed, forcing all diverted fresh air 562 from dehumidification path 558 to remain in the wrap-around airflow path 554. Outside air from dehumidification air path 558 is directed back into intake air path 504 and through a cooling element face damper 526 and an intake cooling element 520. Cooling element bypass damper 528 may modulate, in coordination with cooling element face damper 526, to maintain the most efficient cooling element operating condition. Since the airstream 564 has already been cooled by passage through the evaporator section 512, more of the capacity of the cooling element 520 is available for removing moisture from the airstream 564 before it is passed onward. Conditioned air leaving cooling element 520 is typically at or near the dewpoint temperature, after which it passes through the condensing section 514 of heat pipe 510 where it is reheated to lower relative humidity and prevent downstream condensation. The wrap-around airflow path 554 of diverted fresh air 562 or exhaust air 516, or a mixed airstream 564, passes first through the evaporator section 512 of the heat pipe 510, then through the cooling element 520, then through the condenser section 514 of the heat pipe 510; this provides initial cooling, then further cooling and dehumidification, and then reheating of relatively dry but saturated (due to the reduced temperature) air to prevent further unwanted condensation downstream in ductwork or on other building surfaces. This passive heat transfer process, made possible with the heat pipe, results in a significant reduction in the required capacity of the cooling element 520, necessary to meet the cooling and dehumidification load.

FIG. 6 shows an alternative example of an air processing system 600 which again incorporates many of the basic elements shown in FIG. 4 for the system 400, and which incorporates many of the same elements as the systems 100, 300, and 500. The system 600 again has a dehumidification air path 658 that diverts air from an air intake path 604 and directs it into an exhaust air path 606 at a location upstream of an evaporator section 612 of a heat pipe 610.

The system 600 differs from the system 500 in the configuration of a wrap-around air path 654, which can direct air into the intake air path 604 either directly through a cooling element 620 and a cooling element face damper 626, or through a cooling element bypass damper 628. This eliminates the need for the wrap-around damper 552, shown in FIG. 5. However, in this arrangement, all outside air requiring benefit from the cooling element 620 must pass through the dehumidification air path 658 and the wrap-around airflow path 654. There is no option in the system 600 to cool the incoming air 618 without passing it through the dehumidification air path 658, although it should be appreciated that an additional cooling element for such purpose could be added.

Both systems 500 and 600 should offer even greater energy savings than the system 300, because both outside air 518/618 and exhaust air 516/616 benefit from the wrap-around efficiency obtained by first passing through the evaporator section 612, of the heat pipe 610, then through the cooling element 620, before being reheated by passing through the condenser section 514/614 of heat pipe 510/610, resulting in the maximum operating efficiency and the smallest cooling element capacity necessary to meet the cooling load. System 300, while offering less potential energy savings in warmer climates, still provides superior efficiency when compared to other cooling systems, because exhaust air still benefits from the wrap-around airflow path. With the system 300, the outside air 318 can still be cooled by the cooling element 320 but does not have the benefit of being pre-cooled by the evaporator section 312, which maximizes latent cooling.

In one example of operation of a system such as the system 500 shown in FIG. 5, the system can be operated in either an occupied or unoccupied mode, depending on whether the natatorium is currently in use. To automate operation, either entirely or partially, the system can be provided with appropriate temperature, humidity, and/or air flow sensors such as are known in the art for monitoring air conditions, and with automatically-controlled dampers and variable-speed fans, such as are also well known in the art.

When turned off, the system 500 can be set to default to close the outside air damper 542 and exhaust air dampers 556 and 548, thereby closing off air interchange with the outside. At the same time, the recirculation dampers 538, wrap-around damper 552, bypass dampers 522 and 528, and face dampers 524 and 526 are typically left open to allow air to circulate through the system 500. Such passive circulation is particularly beneficial in cold weather, as it allows warm air from the natatorium to keep elements of the system 500 from freezing.

When the natatorium is in use, the system 500 operates in the Occupied Mode to meet the health and comfort requirements for temperature, humidity, recirculation rate, and fresh air introduction. Typically, in this mode the supply fan 540 operates to provide a constant volume (cfm) of air flow, regardless of changes in other components of the system 500. The supply fan 540 can have an airflow station built into it so that, as dampers change position and airflow paths change, the supply fan 540 changes speed to maintain the same volume of flow despite changes in resistance. If the air flow decreases due to increased resistance caused by a change in the air flow path (such as diverting air through the dehumidification air path 558 rather than introducing it straight from the intake damper 542 through the intake air path 504), the supply fan 540 can automatically speed up to maintain the constant volume. Similarly, if the air flow increases due to reduced resistance, the supply fan 540 can slow down.

The exhaust fan 546 can also be a variable speed fan, and can be controlled by a program that considers two different factors. Most of the time, the speed is adjusted to maintain a constant negative pressure in the natatorium, to prevent the humid air and chlorine compounds from seeping into other areas of the building that houses the natatorium. Adjustment compensates for changes in the amount of fresh air being brought into the natatorium to provide dehumidification or to economize cooling. However, the exhaust fan 546 may change from the fixed (negative) pressure mode to a fixed volume (cfm) mode of operation when the system operates in a mechanical cooling or dehumidification mode. During this change, the pressure drop through cooling elements and dampers changes so the fan speed changes to maintain a constant cfm. The desired CFM is determined by the capacity of the system 500, and typically amounts to 50% of its maximum airflow. Of the 50%, a typical mode of operation may have half the flow being incoming outside air (518 and/or 562) and the other half exhaust air 516, all of which then gets recirculated.

In the Occupied Mode, whenever the room temperature drops below setpoint, the system 500 operates to heat the air in the natatorium. If the outside air is warmer than desired temperature in the natatorium, outside air volume is increased by opening intake damper 542 more, to reduce the heating requirement for air flowing into the natatorium. If the outside air is colder than the desired temperature, then the outside air is reduced to the minimum outside air setting, by partially closing intake damper 542, unless the extra outside air is needed for dehumidification. The system 500 also switches operation into a heat recovery mode, in which all outside air passes through the condenser section 514 of the heat pipe 510, and all exhaust air 516 passes through the evaporator section 514 of the heat pipe 510. In this mode, the heat recovery exhaust damper 556 is 100% open, the wrap around damper 552 is closed, the cooling element face damper 526 and bypass damper 528 are open to minimize air resistance, and the heat pipe exhaust bypass damper 548 is closed to force all outgoing air to pass through the evaporator section 512 to transfer heat to the condenser section 514 to heat incoming air. If necessary, air supplied to the natatorium can be further heated by heating elements 532 and 534.

When the temperature in the natatorium rises above the temperature setpoint when the system 500 is operating in the Occupied Mode, the system 500 acts to cool the air delivered to the natatorium. In conditions where outside air is colder than room air, outside air volume is automatically increased by further opening intake damper 542 to lower room temperature with minimal energy expenditure to cool the air supplied to the natatorium. If the system is in its heat recovery mode, it switches out of such mode and the speed of the exhaust fan 546 is adjusted, along with the outside air damper 542, to deliver the proper amount of fresh air to maintain the desired room temperature (controlled by the amount of fresh air allowed in by the intake damper 542) and pressure (controlled by the exhaust fan 546). If the desired temperature reduction cannot be satisfied with outside air, then the system 500 goes into a cooling mode. When operating in conditions where the outside temperature is warmer than the already too warm room temperature, then the outside air damper 542 goes to a minimum outside air setting (unless more fresh air is required for dehumidification), and the system 500 again switches to operating in a cooling mode. In the cooling mode, the exhaust fan operates similarly to the heat recovery mode, switching from adjusting to maintain constant pressure to maintaining constant volume. Exhaust air 516 passes through the evaporator section 512 of the heat pipe 510, then through the wrap around damper 552, then through the cooling face damper 526 and cooling element 520. Next, the cooled return air passes through the condenser section bypass damper 522 and finally mixes with a portion of return air 536 which has recirculated through recirculation damper 538, which raises the sensible temperature of the supply air to prevent condensation on cold downstream surfaces. This cooled air leaving the cooling element 520 is forced to bypass around the condenser section 514 of the heat pipe 510 because the condenser section face damper 524 is closed and the condenser section bypass damper 522 is open. This prevents the recovery of any heat from air that has passed through the evaporator section 512, of the heat pipe 510. Since it's not picking up any heat, none will be extracted from the return or mixed air 564 passing through the evaporator section 512 of the heat pipe 510.

When the natatorium humidity drops below the humidity setpoint, the system 500 typically has no means of adding humidity, since outside air typically does not have sufficient humidity to provide an increase. In such cases, the system 500 partially closes the intake damper 542 to minimize outside air to prevent further dehumidification. The only reason the room humidity will be too low is because either the pool has no water in it (and hence does not humidify the air by evaporation), or the outdoor weather conditions are at a substantially lower temperature, and thus the incoming fresh air lacks sufficient water vapor. Most natatoriums have difficulty in the wintertime maintaining a reasonably high humidity while bringing in the required amount of fresh air. Too much of the cold fresh air may overly dehumidify the natatorium. Supplemental humidification capacity can be added to the system if desired.

Whenever the humidity in the natatorium is greater than the setpoint, the required functions of humidity control take precedence over demands for temperature control. If possible, the system 500 first attempts to dehumidify the natatorium with a variable amount of fresh air. This will almost always be the case when outdoor temperatures are below room temperature. In this case the fresh air damper 542 modulates to maintain the desired humidity level and the exhaust fan 546 modulates to maintain the desired room pressure. If the outdoor temperature is below the room temperature, then the system 500 goes into a heat recovery mode where all fresh air and exhaust air pass through the heat pipe 510, but not through the dehumidification path 558 or through wrap around damper 552. This mode of operation provides a similar effect to that of the prior art system 100 shown in FIG. 1, using outside air for cooling as much as possible to reduce energy consumption. However, this mode of operation is not suitable for conditions where the outside air is too hot and/or humid. If the outdoor temperature is close to the room temperature, then the bypass dampers 522 and 548 on the heat pipe 510 open to reduce pressure drop and fan energy, because heat recovery is not necessary. Both the face damper 524 and bypass dampers 522 and 548 on the heat pipe 510, and the face damper 526 and bypass damper 528 on the cooling element 520 are open, reducing air velocity through the heat pipe 510 and cooling element 520.

In the event that the outdoor dewpoint temperature is too high to be using outside air 518 for dehumidification, then the system 500 operates in a mechanical dehumidification mode. The exhaust fan 546 reverts to a fixed volume mode of operation, and typically operates such that the volume of air it moves is half that of the supply fan 540. The outside air damper 542 partially closes to the minimum outside air setting (allowing in approximately one quarter of the Supply Fan cfm). About half of the air drawn from the natatorium gets drawn through the recirculation damper 538 by the supply fan 540, while the remaining air 516 mixes with the diverted fresh air 562 and goes through the exhaust fan 546 to enter the wrap around path 554 and through the wrap around damper 552. The heat pipe exhaust bypass damper 548 now modulates to maintain the room negative pressure. The Cooling Element Face damper 526 opens and the heat recovery exhaust damper 556, along with the outside air bypass damper 568 are closed. The cooling element 520 may be turned on to partial or full capacity; since the mixed air 564 is cooled by passage through the evaporator section 512, the cooling element 520 can operate more efficiently, as the air passing through it has already been cooled close to its dewpoint.

A significant advantage of the system is that it can not only use the heat pipe to improve efficiency when operating in a heat recovery mode (in a manner similar to Applicant's prior art heat pipe systems), but can also use the heat pipe to improve efficiency when operating in the mechanical dehumidification mode. The ability to take advantage of the heat pipe in both modes of operation allows the system to provide more efficient operation in a much greater range of operating conditions, and should be especially beneficial when operating in warmer locations where the outside air is too humid during a significant portion of the operating time.

When the system 500 is operating in an Un-Occupied Mode, when the natatorium is not in active use and the requirements for air quality for the health and comfort of users need not be met, the system 500 can operate following the same basic modes as during Occupied Mode, but modified to reduce energy consumption. Typically, the speed of the supply fan 540 is reduced to a level where there is still enough circulation to prevent condensation on surfaces in the natatorium. This speed is determined by experience with each specific application. The supply fan speed can be adjusted automatically through the control program, or manually from a keypad. To significantly reduce energy consumption, the temperature and humidity in the natatorium can be allowed to deviate above and below the normal setpoints. The humidity might be allowed to climb 5 to 10% and the temperature to drop or rise 5 degrees below or above the setpoint. Once it exceeds those deviations, then the unit goes back into operation to dehumidify, heat, or cool as if it is in Occupied Mode. Once the temperature and humidity are back within the desired ranges, the system 500 returns to the Un-Occupied Mode. The Un-Occupied Mode of operation serves to reduce damage due to condensation, and maintains the system 500 and the natatorium that it services within a temperature and humidity range where it can be readily brought into conformity with health requirements when the natatorium is again occupied. In a typical schedule of operation, the system can be programmed to switch from the Occupied Mode to the Unoccupied Mode when the natatorium closes at the end of the day, operating in the Unoccupied Mode overnight to reduce energy consumption, and then switching back the Occupied Mode shortly before the natatorium opens again, to assure that health requirements are met by the time that the natatorium is again in use.

Prior art systems employing a heat pipe, such as the system 100 shown in FIG. 1, are designed to provide energy savings whenever outside air is suitable for dehumidification. This system is effective better than 95% of the operating hours in the northern part of the United States, due to normal weather conditions. In southern parts of the US, outside air dewpoint temperatures are frequently too high to accomplish dehumidification with outside air, in which case it is necessary to rely on mechanical cooling for moisture removal, during these high dewpoint periods.

A system employing a wrap-around air path, such as the system 300 shown in FIG. 3, represents an enhancement to the Prior Art that allows the system to operate efficiently even when outdoor dewpoint temperatures are too high to permit dehumidification with outside air. When mechanical dehumidification is required, the system 300 operates such that recirculated air, typically amounting to 25% of the total circulation rate, is passively precooled by the passive evaporator section 312 prior to mixing with outside air 318 (which typically represents an additional 25% of the total circulation rate, before being further cooled by cooling element 320, and finally passively reheated by the condenser section 314. Based on 25 years of experience with the prior art, Applicant estimates that the fan energy required to process air through the wrap-around air path will be slightly reduced when compared to non-mechanical cooling operation, because the exhaust fan speed is cut to 50% of the normal speed, more than offsetting the added pressure drop of passing air through the heat pipe evaporator section (precooling) and heat pipe condenser section (reheating). Air pressure drop through the cooling coil would also be slightly reduced, because the reduction in required cooling capacity, afforded by precooling return air, will allow for a cooling coil with fewer rows and fins per inch, and thus the cooling element can be designed to reduce the resistance to airflow, which otherwise would cause an increase in fan horsepower. While it appears that fan energy should be reduced by use of systems such as taught herein, Applicant has not attempted to calculate such reduction, since the reduction in energy used for dehumidification appears to be much more significant, as discussed below.

Based on accepted engineering principles, firsthand experience, and application-specific results from computer modeling, it is estimated that the precooling of return air in a system such as shown in FIG. 3 will reduce total required cooling capacity by an average of 14%. A nationally recognized computer modeling program provided by a third party (Advanced Cooling Technologies, Inc. of Lancaster, Pa., with website www.1-act.com) to estimate the energy consumption. For an exemplary calculation, a system which circulates 10,000 cfm was used for the calculations. Based on a 10,000 cfm circulation rate, the system pre-cooled 2,500 cfm of return air, mixed it with 2,500 cfm of outside air, then passed the 5,000 cfm of mixed air through a cooling coil, and then reheated the 5,000 cfm with the reheat (condenser) section of the heat pipe. Compared to a system without the wrap-around air path (such as shown in FIG. 1), the computer model showed a savings of 64,400 btu/h, based on a total required cooling capacity of 365,600 btu/h. This represents a savings of 17.6%. While Applicant's experience validates such modeled performance when testing a new system, it has been found in actual use that heat transfer surfaces experience a reduction in efficiency as they become coated with various airborne contaminants, namely chloramines in a natatorium application. Unless good maintenance practices are adhered to, it is realistic to see as much as a 20% reduction in heat recovery performance over the lifetime of the system. Therefore, it felt confident that a conservative estimate of total energy savings for a system such as shown in FIG. 3 would be about 14%.

A similar analysis was modeled to compare the prior art system 100 to the system 500 shown in FIG. 5. Again, the calculation used a 10,000 cfm system, circulating 10,000 cfm. For the system 500, 2,500 cfm of outside air (passed through the dehumidification path 558) was mixed with 2,500 cfm of return air, prior to entering the evaporator section 512 of heat pipe 510, after which this pre-cooled mixed air passed through cooling element 520, and then was reheated by condenser section 514 of heat pipe 510. Based on outside air at the same conditions as room air, the computer model calculated a savings of 128,700 btu/h. This represents a 35.2% reduction in required mechanical cooling capacity. However, there are two factors affecting these results. First, as discussed above for the example for the system 300, experience indicates that there would be a reduction in efficiency due to unwanted coating of the coil. Based on a conservative estimate of 20% reduction in performance over the life of the system, it would result in an adjusted average savings of 28%. A second factor effecting performance would be the actual entering conditions of the outside air. While the return air conditions will remain constant (the purpose of the dehumidification system), the outside air will typically be at a higher dewpoint temperature, requiring more cooling capacity. As the total required cooling capacity increases, the % savings will also increase. Consequently, it is a conservative expectation to obtain a 28% reduction in mechanical cooling energy by the implementation of system 500, when compared to system 100, or any other mechanical cooling/dehumidification system which may be applied in a natatorium application.

While the novel features have been described in terms of particular embodiments and preferred applications, it should be appreciated by one skilled in the art that substitution of materials and modification of details can be made without departing from the spirit of the invention.

The invention claimed is:

1. An air processing system comprising:
- an intake air path;
- an exhaust airflow path;
- a vertical heat pipe having,
  - an evaporator section positioned to extract heat from air flowing through said exhaust air path, and
  - a condenser section positioned to supply heat to air flowing through said intake air path;
- a fresh air dehumidification air path that introduces fresh air into said exhaust air path at a location upstream of said evaporator section of said heat pipe to mix with exhaust air;
- a wrap-around air path located downstream of said evaporator section for selectively introducing mixed fresh air and exhaust air that has passed through said evaporator section into said intake air path at a location upstream of said condenser section of said heat pipe; and
- a cooling element positioned to receive mixed fresh air and exhaust air from said wrap-around air path so as to cool such mixed air prior to it passing through said condenser section of said heat pipe.

2. The air processing system of claim 1 wherein said cooling element is positioned in said intake air path upstream of said condenser section and downstream of the location where said wrap-around air path introduces exhaust air into said intake air path.

3. The air processing system of claim 1 wherein said cooling element is positioned in said wrap-around air path.

4. The air processing system of claim 1 wherein said fresh air dehumidification air path is configured to selectively divert incoming fresh air from said intake air path at a location upstream of said condenser section of said heat pipe.

5. The air processing system of claim 1 further comprising:
- a supply fan that draws air through said intake air path;
- an exhaust fan that blows air through said exhaust air path;

an arrangement of dampers for controlling the air flow through said air paths, including a recirculation damper that diverts air from said exhaust air path at a location upstream of said evaporator section into said intake air path at a location downstream of said condenser section.

6. The air processing system of claim 5 wherein said arrangement of dampers includes dampers for selectively diverting air in said exhaust air path to bypass said evaporator section and dampers for diverting air in said intake air path to selectively bypass said condenser section.

* * * * *